US005306164A

United States Patent [19]

Hollander et al.

[11] Patent Number: 5,306,164

[45] Date of Patent: Apr. 26, 1994

[54] ELECTRICAL CONNECTOR WITH ADAPTABLE EXTERNAL GROUND AND INDICIA DISPLAY

[75] Inventors: Milton B. Hollander, Stamford; David R. Jacobs, Norwalk; William E. McKinley, Stamford; Janice E. Angrave, Danbury, all of Conn.

[73] Assignee: Omega Engineering, Inc., Stamford, Conn.

[21] Appl. No.: 22,674

[22] Filed: Mar. 1, 1993

Related U.S. Application Data

[63] Continuation-in-part of Ser. No. 952,478, Sep. 25, 1992, abandoned, which is a continuation of Ser. No. 639,355, Jan. 16, 1991, abandoned.

[51] Int. Cl.[5] ..... H01R 13/652

[52] U.S. Cl. ..... 439/103; 439/106; 439/488

[58] Field of Search ..... 439/102-106, 439/170-176, 488, 491

[56] References Cited

U.S. PATENT DOCUMENTS

| | | | |
|---|---|---|---|
| 2,922,134 | 1/1960 | Elfenbein | 439/104 |
| 2,984,808 | 5/1961 | Bender | 439/104 |
| 3,275,972 | 9/1966 | Eisert | 439/491 |
| 3,753,216 | 8/1973 | Johnson et al. | 439/491 |
| 3,825,875 | 7/1974 | Garrett | 439/103 |
| 3,958,849 | 5/1976 | Blairsdale | 439/104 |

FOREIGN PATENT DOCUMENTS

| | | | |
|---|---|---|---|
| 581191 | 10/1946 | United Kingdom | 439/106 |

*Primary Examiner*—Gary F. Paumen

*Attorney, Agent, or Firm*—Bruce E. Hosmer; Howard S. Reiter

[57] ABSTRACT

A separable electrical connector with a housing formed of electrically insulating material includes an external grounding terminal anchor positioned in a grounding strip groove on the surface of the housing. The groove, in the form of an open-sided recess, receives and positions a suitably dimensioned grounding strip of electrically conductive material. The strip is coupled to the anchor by a screw fastener which engages mating screw threads formed in the anchor. One or more display surfaces surrounded by upstanding protective wall surfaces are formed on the exterior surface of the housing for the display of identifying indicia, and the base surf ace of the external grounding strip groove may be used as a display surface, if desired, in the absence of a grounding strip. The grounding terminal anchor may be made of electrically conductive material so that an anchored conductive grounding strip will be coupled to the housing both electrically and mechanically. When formed of conductive material, the grounding terminal anchor may serve as an electrical coupling between a conductive member mounted on the housing and one or more external conductors, or it may serve as a coupling between two or more conductors external to the housing, while serving at the same time as a mechanical coupling between the housing and the external conductors.

3 Claims, 1 Drawing Sheet

ELECTRICAL CONNECTOR WITH ADAPTABLE EXTERNAL GROUND AND INDICIA DISPLAY

This application is a continuation-in-part of application Ser. No. 07/952,478 filed Sep. 25, 1992, now abandoned, which is a continuation of Ser. No. 07/639,355 filed Jan. 16, 1991, now abandoned.

BACKGROUND OF THE INVENTION

This invention relates generally to separable electrical connectors, and more specifically to an improved connector having provision for a separable and removable grounding strip to achieve electrical grounding and mechanical coupling with or between one or more mating devices independently of the current-carrying electrical contacts associated with the connector, and also having provision for conveniently labeling the connector with desired identifying indicia.

Electrical connectors with grounding contact members are well known in this art. It is common in such connectors, to provide one or more grounding contact elements which engage and disengage from mating connectors in a manner identical to the current-carrying contact elements. Such grounding contacts do not perform any significant additional mechanical coupling functions; and, by their nature, they must be engaged and disengaged simultaneously with the current-carrying contacts.

In various electrical connector applications, there is a need to separate the grounding function connections from the current carrying connections, for such purposes as: completing these connections independently of each other; or dispensing with the grounding connection entirely; or providing grounding for circuit elements which are not readily connectable through the interior of the connector. In addition, it may be desirable in some applications to combine the grounding connection with a mechanical coupling of the connector to a mating connector or utilization device, independently of the current-carrying function. In connectors such as these, which are capable of diverse coupling arrangements, it may be necessary or desirable to provide a means for informing users and operators about specific coupling arrangements or other unique aspects of particular applications.

Accordingly, it is an object of this invention to provide an electrical connector having the capability of being electrically grounded and mechanically coupled to a mating device independently of the current-carrying function of the connector.

It is another object of this invention to provide a connector having means for combining the grounding connection and a mechanical coupling function in a simple and economical manner.

It is another object of this invention to provide a connector in which grounding between circuit elements external to the connector can be accommodated readily.

It is still another object of this invention to provide a connector of the type described having readily locatable and clearly visible means for displaying identifying indicia.

It is still another object of this invention to provide a connector of the type described which is convenient to use and which is adaptable for grounding with various different mating connectors and devices in a wide variety of installations and configurations.

A feature of this invention is a connector housing having an open-sided guide recess formed in an outer wall of the housing, for receiving and positioning a separate and independent grounding strip of conductive material, and a grounding element, accessible within the recess and engageable with the grounding strip for electrically coupling the connector to a mating device.

Another feature of this invention is a connector housing having an open-sided guide recess for a grounding element of the type described, together with a display recess formed in a visible location on an outer wall of the housing and having a planar base surface for supporting and displaying indicia thereon.

These and other and further objects, features and advantages of this invention will be made apparent to those having skill in this art, by reference to the following description and to the accompanying drawings, in which:

DESCRIPTION OF THE INVENTION

Figure 1:
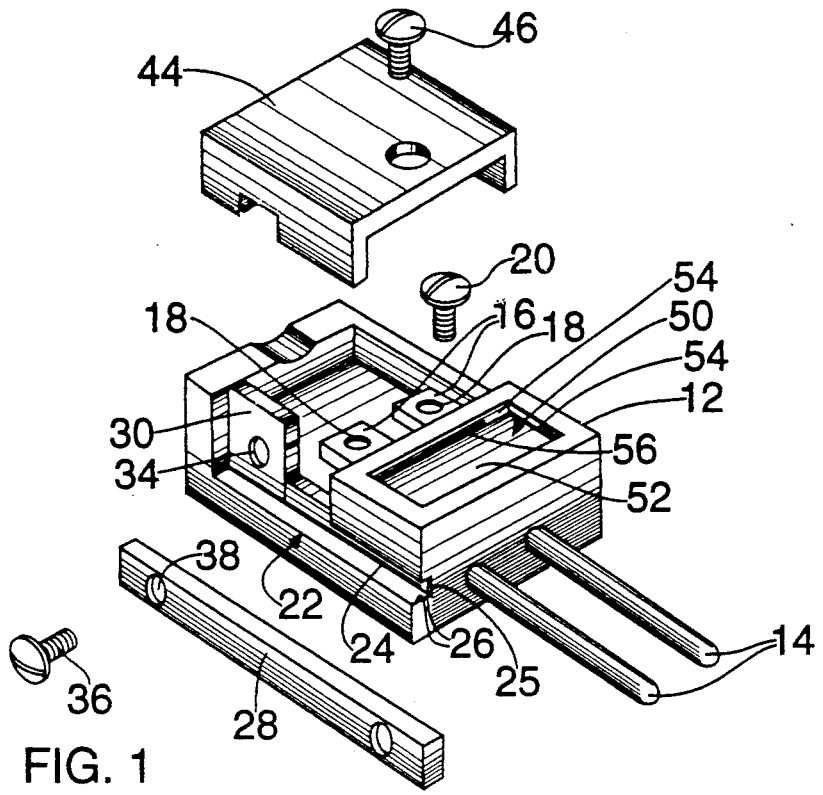
FIG. 1 is an exploded pictorial representation of one embodiment of this invention, showing a male connector with a straight-line grounding strip aligned for coupling to the connector.

Referring now more specifically to FIG. 1 of the drawings, it may be seen that the male connector 10, comprises a housing or body member 12 having a pair of male contact elements 14 extending therefrom in a well-known form of construction. The contacts 14 may be coupled to the body 12 in any known manner; for example: by being molded in place when the housing is formed from molten plastic. Although male contact elements 14 are shown in FIG. 1, this invention is readily adaptable to any form of contact element; for example, in FIG. 2, a different embodiment is illustrated, incorporating female contact elements 14' disposed substantially entirely within a housing 12'. The contact element 14' is more fully illustrated in FIG. 3, where it may be seen to include in a well-known manner, a pair of parallel, spaced-apart shaped fingers 15' extending from a common base terminal portion 16'. The fingers 15' may be resiliently spread apart to receive a mating contact element such as male prong contacts 14 of FIG. 1. Terminal portion 16' may include a threaded aperture 18' for receiving a threaded fastener as described below with reference to the embodiment of FIG. 1.

Referring again to FIG. 1, the contacts 14 are seen to be provided with terminal portions 16 on housing 12, for attachment to external conductors (not shown) such as electrical wires. The illustrated terminals are threaded apertures 18 which receive screw fasteners 20, to capture a conductor under the head of the screw in a well-known manner, so as to form an electrical connection between the conductor and the contacts 14. It should be noted that any suitable form of terminal coupling may be used for this purpose.

Because it may be desirable in some applications of electrical connectors to protect the connections at terminals 16 from exposure to unintended contact with operators or electrically conductive surfaces, housing 12 is provided with a removable cover member 44. The cover 44 may be configured as desired to accommodate passage of wire conductors to terminals 16 from the exterior of the housing, and to capture parts such as grounding element 30 between the cover and the housing. The purpose and function of grounding element 30 will be described fully, below. Cover 44 may be coupled to the housing 12 in any suitable manner, as, for example, by screw 46.

In accordance with this invention, an open-sided grounding recess 22 is formed in one side of the housing 12. The recess includes a floor surface 24 and a pair of opposed, spaced-apart side walls 26, which support and position a grounding conductor strip 28 formed of conductive material. Strip 28 is provided with an end portion dimensioned to be received within the recess. The open-sided configuration of the recess facilitates attaching the grounding strip to the housing, and accordingly facilitates substitution and exchange of grounding conductors having various sizes, configurations and mating coupling characteristics. One end of the recess is open, as at 25, 25', to permit smooth, continuous emergence of a conductor strip from the recess. However, it should be recognized that a strip may be configured to accommodate a transverse obstruction across the width of the recess so as to provide added resistance to longitudinal displacement of the strip. The obstruction in such case may occupy the full depth and width of the recess, or any part thereof.

Further in accordance with this invention, a grounding anchor element 30 is mounted to the housing in position to be accessible for connection with a grounding strip received within recess 22. As shown, the grounding element is set flush within recess 22 on the floor surface 24. A threaded aperture 34 in element 30 is provided to receive a screw 36 which serves to couple a grounding strip 28 to the grounding element 30 within recess 22. The grounding anchor element 30 may be electrically conductive and may be integrally formed with, or attached to a grounding structure or circuit of any desired configuration and known design associated with or carried by the housing, to achieve satisfactory ground protection for a connector. Accordingly, the grounding anchor element 30 may serve as both an electrical and a mechanical coupling between the connector and one or more external devices. Subject to the design configuration of any grounding structure or elements in housing 12 to which element 30 is coupled, element 30 may be mounted to the housing in any convenient manner. For example, in FIG. 1, element 30 may be slidably received in a suitable slot or recess in housing 12 and retained in that position by engagement with a suitable abutting surface or surfaces on cover member 44 when the cover is secured in mating relationship with the housing. In the embodiment illustrated in FIG. 2, grounding element 30' may be integrally molded in position when the housing 12' is formed from molten plastic.

Figure 2:
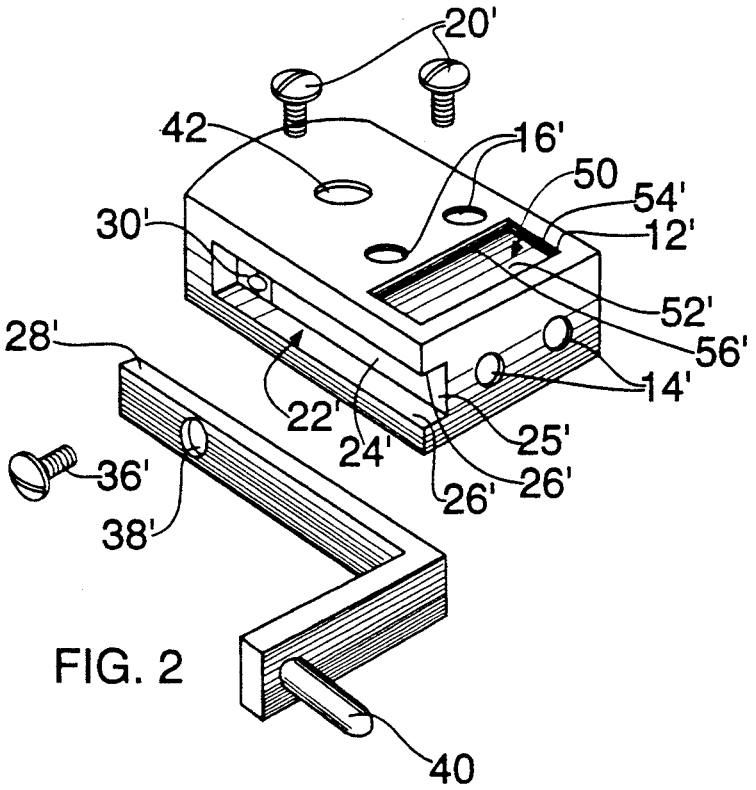
FIG. 2 is a pictorial representation of the invention, in the form of a female connector, aligned for coupling with a grounding strip having a right angle configuration.

Grounding strips suitable for use with this invention may extend from the recess 22 in any desired configuration for engaging another connector or a utilization device, and may be formed of any suitable conductive material. For the purpose of illustrating another grounding strip configuration, FIG. 2 shows a grounding strip 28', having a right angle configuration, and a projecting stud 40 for electrical and mechanical coupling with a mating ground device. Grounding strips of any suitable configuration such as 28, 28', are provided with access holes 38, 38' to receive grounding screws 36, 36' for coupling the strip to a grounding element 30, 30' within the recess. Screws such as 36, 36' represent a convenient and economical form of separable connection for joining a strip to the grounding element 30. It will be recognized readily that other forms of separable couplings or fasteners my be substituted readily for the screw threaded fasteners illustrated in these embodiments. Similarly, although strips of uniform width have been illustrated for use with these embodiments of this invention, it will be recognized that only the end portion of the strip 28, 28' which is received within the recess should have a uniform shape consistent with the recess; the end of a strip remote from the recess, which is coupled to a mating connector or utilization device, may have any desired configuration and coupling means consistent with the structure or structures to which it will be attached.

Referring now to FIG. 2, an alternative form of a connector in accordance with this invention is shown to embody female contact elements 14' disposed substantially within the housing 12'. In this embodiment, the housing 12' is molded in one piece, with contacts 14' embedded in place. Terminal portions 16' extend through the outer wall of the housing 12' where they are accessible for engagement by screws 20' for electrically coupling wire conductors to the contacts 14' in the manner previously described. If desired, an opening 42 extending through to another surface of the housing may be provided. By passing external wire conductors through the opening 42 one or more times, the wires may be more securely coupled to the housing to relieve mechanical stress on the coupling formed by terminal screws 20'.

In the embodiment illustrated in FIG. 2, grounding strip 28 is shown having a right-angle configuration, as previously explained. It should be understood that the capability of accommodating a given connector housing to a wide variety a grounding applications by permitting use of grounding strips having numerous different sizes, shapes and configurations, is an important feature of this invention.

To provide a means for displaying indicia concerning the connector and/or a particular application in accordance with an object of this invention, the housing 12 includes a display window 50, as shown in FIG. 1. The window comprises a base surface 52 surrounded by upstanding side walls 54, In the embodiment illustrated in FIG. 1, surface 52 is recessed below the outer surface of housing 12, and sidewalls 54 extend between surface 52 and the outer surface of the housing. It should be apparent, however, that the sidewalls 54 could be formed as a wall extending outwardly from the surface of the housing 12, with base surface 52 flush with or even raised above the outer surface of the housing. regardless of the relative positions of base surface 52 and the outer surface of housing 12, the upstanding sidewalls 54 serve to protect the base surface 52 from inadvertent wiping motions which might tend to dislodge or deface indicia positioned on that surface.

Figure 3:
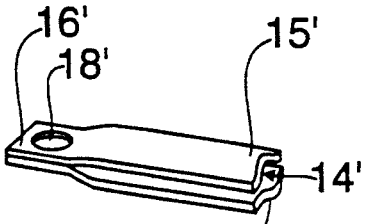
FIG. 3 is a pictorial representation of a female electrical contact element suitable for disposition within the body of the housing illustrated in FIG. 2.

FIG. 2 illustrates a housing, for female contact elements such as shown in FIG. 3, incorporating a corresponding display window 50' having a base surface 52' with sidewalls 54' that may be grooved as at 56' for the purpose described in this disclosure with reference to display window 50.

Suitable indicia such as letters, numbers, symbols or combinations thereof may be positioned on surface 52 by affixing written or printed labels thereto or by marking directly on the surface. For this purpose, the surface may be textured or otherwise treated in any well known manner to facilitate marking as well as removal of undesired markings. And, it will be understood that the surface is preferably of planar configuration for most convenient use.

To further facilitate use of the display window 50 an opposed pair of sidewalls 54 may be provided with grooves 56 opening toward each other, to capture a flexible display card or clear protective window between them, in a well known manner. The display card may have indicia affixed or marked thereon directly, to avoid the need for marking on surface 52. It will also be appreciated that the base surface 24 (24') of grounding recess 22 (22') may be used as a display window when it is not being used for its intended grounding function as well as when it is being used for its grounding function. To use recess 22 (22') as a display window in accordance with this invention, the sidewalls 26 may be provided with opposed grooves as previously explained to retain a suitable display card or clear protective window. And, it will be obvious that the surface 24 (24') may be treated to permit marking and removal of indicia without in any way interfering with the grounding function herein described.

The specification and drawings herein set forth clearly and fully describe a preferred embodiment of this invention, but it should be readily apparent to those having skill in this art that other forms, embodiments and variations thereof may be conceived and constructed without departing from the spirit and scope of the following claims.

What is claimed is:

1. A groundable, separable electrical connector comprising:

a body member formed of electrically insulating material with at least one contact element having a longitudinal mating axis;

said body member having an elongated flat-bottomed recess of substantially rectangular cross-section formed in the outer surface thereof, at least part of said recess being aligned parallel to said mating axis for receiving therein a grounding conductor in the form of a strip of conductive material having a substantially rectangular cross-section;

a grounding conductor anchor element mounted to said body member within said recess and having its outer most surface substantially flush with the bottom surface thereof;

said grounding conductor anchor element having a threaded aperture therein to receive a mating threaded screw for separably securing the grounding conductor strip thereto;

an information display area integrally formed in said body member, said display area being characterized by a substantially flat, planar base surface recessed below the outer surface of said body member, and by a circumscribing, integrally formed upstanding sidewall completely encircling said base surface and extending between said base surface and said outer surface;

said integrally formed base surface being treated in known manner to render it readily erasable and readily markable using conventional writing and marking instruments;

said information display area being positioned on said body member in substantially close proximity to a contact element mounted on said housing for permitting convenient observation of said base surface of said display, and said contact element, at substantially the same time.

2. The groundable connector in accordance with claim 1, wherein said contact element is an elongated male prong, and said body member includes an opening to the exterior thereof allowing said prong to extend outwardly therefrom along a path substantially parallel to said mating axis.

3. The groundable connector in accordance with claim 1, wherein said contact element is an elongate female receptacle disposed within said body member in substantial parallel alignment with said mating axis, and said body member includes an opening from the exterior to the interior thereof aligned with and allowing access to the interior of said contact element for insertion of a mating contact element.

* * * * *